US007556485B2

(12) United States Patent
Kanayama et al.

(10) Patent No.: US 7,556,485 B2
(45) Date of Patent: Jul. 7, 2009

(54) ROTARY COMPRESSOR WITH REDUCED REFRIGERATION GAS LEAKS DURING COMPRESSION WHILE PREVENTING SEIZURE

(75) Inventors: Takehiro Kanayama, Kusatsu (JP); Taisei Tamaoki, Hachioji (JP); Keiji Komori, Kusatsu (JP); Hiroyuki Taniwa, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 21 days.

(21) Appl. No.: 11/792,830

(22) PCT Filed: Dec. 12, 2005

(86) PCT No.: PCT/JP2005/022789

§ 371 (c)(1),
(2), (4) Date: Jun. 12, 2007

(87) PCT Pub. No.: WO2006/064769

PCT Pub. Date: Jun. 22, 2006

(65) Prior Publication Data

US 2008/0101976 A1 May 1, 2008

(30) Foreign Application Priority Data

Dec. 13, 2004 (JP) ..... 2004-359833

(51) Int. Cl.
*F04C 18/00* (2006.01)
*F04C 2/00* (2006.01)

(52) U.S. Cl. ..... 418/66; 418/64; 418/67

(58) Field of Classification Search ..... 418/63–67, 418/259, 266–268
See application file for complete search history.

(56) References Cited

FOREIGN PATENT DOCUMENTS

| | | | | |
|---|---|---|---|---|
| JP | 57-176686 | U | * | 8/1982 |
| JP | 08-159070 | A | | 6/1996 |
| JP | 09-088852 | A | | 3/1997 |
| JP | 09-112466 | A | | 5/1997 |
| JP | 10-047278 | A | | 2/1998 |
| JP | 10169580 | A | * | 6/1998 |
| JP | 2000179472 | A | * | 6/2000 |

* cited by examiner

*Primary Examiner*—Theresa Trieu
(74) *Attorney, Agent, or Firm*—Global IP Counselors

(57) ABSTRACT

A rotary compressor includes a cylinder body, end plate members fitted on both sides of the cylinder body, a roller placed in a cylinder chamber, a blade fitted to the roller, and a bushing for supporting the blade. A width of the bushing in a roller axis direction is larger than an axial width of the roller. A gap in the roller axis direction between the roller and the end plate members is larger than a gap in the roller axis direction between the bushing and the end plate members.

6 Claims, 4 Drawing Sheets

ROTARY COMPRESSOR WITH REDUCED REFRIGERATION GAS LEAKS DURING COMPRESSION WHILE PREVENTING SEIZURE

CROSS-REFERENCE TO RELATED APPLICATIONS

This U.S. National stage application claims priority under 35 U.S.C. §119(a) to Japanese Patent Application No. 2004-359833 filed in Japan on Dec. 13, 2004, the entire contents of which are hereby incorporated herein by reference.

TECHNICAL FIELD

The present invention relates to a rotary compressor to be used, for example, in air conditioners or the like.

BACKGROUND OF THE INVENTION

Conventionally, a rotary compressor includes a cylinder body, and end plate members provided on both ends of the cylinder body. The cylinder body and the end plate members define a cylinder chamber. A roller is placed in this cylinder chamber. A blade is integrally fitted to the roller, and both sides of the blade are sealed by a bush. By these blade and roller, the interior of the cylinder chamber is partitioned into a low-pressure chamber and a high-pressure chamber. A gap along the roller axis direction is formed between the roller and the end plate members. Then, the gap in the roller axis direction between the roller and the end plate members, and the gap in the roller axis direction between the bush and the end plate members, are generally identical to each other (see JP 8-159070 A).

However, in this conventional rotary compressor, since the gap in the roller axis direction between the roller and the end plate members and the gap in the roller axis direction between the bush and the end plate members are generally identical to each other, refrigerant gas present in the high-pressure chamber, during compression, would pass through the gap in the roller axis direction between the bush and the end plate members to leak to the low-pressure chamber, disadvantageously. Also, the refrigerant gas would flow from a space located outer than the bush in the radial direction of the roller (a space behind the bush), through the gap in the roller axis direction between the bush and the end plate members, directly into the cylinder chamber, as another disadvantage. This leak of the refrigerant gas has been a factor of performance degradation of the rotary compressor.

SUMMARY OF THE INVENTION

Accordingly, an object of the present invention is to provide a rotary compressor which is reduced in refrigerant gas leaks during compression while preventing seizures of the roller and end plate members in compression.

In order to achieve the above object, according to the present invention, there is provided a rotary compressor comprising:

a cylinder body;

end plate members placed on both sides of the cylinder body;

a roller and a blade integrally fitted to the roller wherein a cylinder chamber defined by the cylinder body and the end plate members is internally partitioned into a low-pressure chamber and a high-pressure chamber by the roller and the blade; and a bush which seals both sides of the blade, wherein a width of the bush in a roller axis direction is larger than an axial width of the roller, and a gap in the roller axis direction between the roller and the end plate members is larger than a gap in the roller axis direction between the bush and the end plate members.

In this rotary compressor, even if the roller is affected by flexure due to a differential pressure between the high-pressure refrigerant gas and the low-pressure refrigerant gas or thermal expansion due to the high-pressure refrigerant gas, the end face of the roller and the end faces of the end plate members are not brought into pressure contact with each other. As a result, seizures between the roller and the end plate members are prevented.

Also, in the tightening of the end plate member and the cylinder body to each other by bolts, even if the end plate member near the bolts is deformed, the end face of the roller and the end face of the end plate member are not brought into pressure contact with each other. Thus, seizures of the roller and the end face of the end plate member are prevented.

Further, in compression, the refrigerant gas present in the high-pressure chamber can be prevented from passing through the gap in the roller axis direction between the bush and the end plate members and leaking into the low-pressure chamber. Moreover, the refrigerant gas can be prevented from leaking into the cylinder chamber from a space located outer than the bush in the radial direction of the roller (i.e., a space behind the bush).

Thus, seizures between the roller and the end plate members in compression can be prevented so that the reliability is maintained while leaks of the refrigerant gas in compression are reduced. Thus, the rotary compressor can be improved in performance.

Further, since the gap in the roller axis direction between the bush and the end plate members can be reduced, oblique contact of the bush against the end plate members can be prevented, so that reduction in swing loss of the blade as well as prevention of abnormal wear of the bush can be achieved.

In an embodiment, the width of the bush in the roller axis direction is larger than a width of the blade in the roller axis direction, and a gap in the roller axis direction between the blade and the end plate members is larger than a gap in the roller axis direction between the bush and the end plate members.

In this embodiment, the width of the bush in the roller axis direction is larger than the width of the blade in the roller axis direction, and the gap in the roller axis direction between the blade and the end plate members is larger than the gap in the roller axis direction between the bush and the end plate members. Therefore, contact between the blade and the end plate members in compression can be avoided, so that seizures of the blade can be prevented.

In an embodiment, a width in the roller axis direction in a sealed portion of the blade sealed by the bush is smaller than the axial width of the roller, and a gap in the roller axis direction between the sealed portion in the blade and the end plate members is larger than the gap in the roller axis direction between the roller and the end plate members.

In this embodiment, the width in the roller axis direction in the sealed portion of the blade is smaller than the axial width of the roller, and the gap in the roller axis direction between the sealed portion in the blade and the end plate members is larger than the gap in the roller axis direction between the roller and the end plate members. Therefore, lubricating oil more easily enters to between the sealed portion and the bush, so that the blade and the roller move smoothly against the bush. Thus, loss of the compression operation can be reduced.

In an embodiment, in an inner surface of the cylinder body, a suction hole is provided so as to open to the low-pressure chamber and to suck a refrigerant gas into the low-pressure chamber, and the bush is provided in the vicinity of the suction hole.

In this embodiment, since the bush is provided in the vicinity of the suction hole, the bush can be brought into contact with the cold refrigerant gas that is sucked through the suction hole, so that thermal expansion of the bush can be suppressed. Thus, excessive wear of the bush can be prevented.

In an embodiment, the roller is revolved in the cylinder chamber to compress the refrigerant gas present in the cylinder chamber, as viewed in the roller axis direction, an angle formed by a line interconnecting a revolutionary center of the roller and a center of the bush and a line interconnecting the revolutionary center of the roller and a center of the suction hole is approximately 10 degrees.

In this embodiment, since the angle formed by the line interconnecting the revolutionary center of the roller and the center of the bush and the line interconnecting the revolutionary center of the roller and the center of the suction hole is approximately 10 degrees. Therefore, thermal expansion of the bush can be effectively suppressed by the cold refrigerant gas, and moreover strength of portions in the cylinder body at which the blade is held can be improved.

In an embodiment, in a cross section orthogonal to a direction in which the blade extends, a width of one side face of the blade on the low-pressure chamber side in the roller axis direction is preliminarily set larger than a width of the other side face of the blade on the high-pressure chamber side in the roller axis direction.

In this embodiment, the width of one side face of the blade on the low-pressure chamber side in the roller axis direction is preliminarily set larger than the width of the other side face of the blade on the high-pressure chamber side in the roller axis direction. Therefore, the cold refrigerant gas on the low-pressure chamber side is brought into contact with the one side face while the hot refrigerant gas on the high-pressure chamber side is brought into contact with the other side face. Thus, even if the other side face has greater thermally expanded as compared with the one side face, the width of the other side face does not become larger than the width of the one side face so that the other side face is kept from contact with the end plate members. Therefore, seizures of the blade can be prevented.

DETAILED DESCRIPTION OF THE INVENTION

Hereinbelow, the present invention will be described in detail by embodiments thereof illustrated in the accompanying drawings.

First Embodiment

Figure 1:
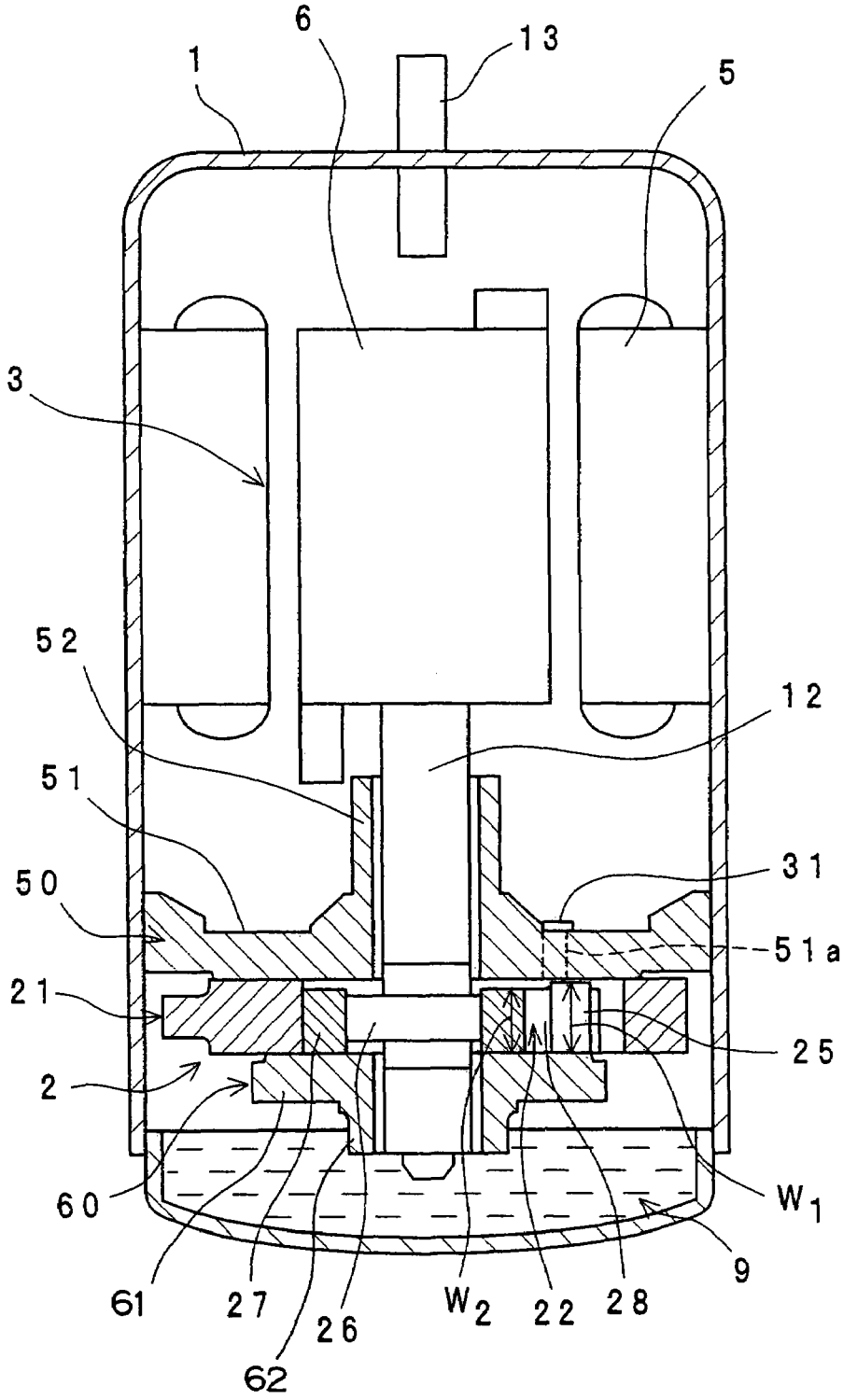
FIG. 1 is a vertical sectional view showing a first embodiment of the rotary compressor according to the present invention.

FIG. 1 shows a vertical sectional view of an embodiment of the rotary compressor according to the present invention. This rotary compressor, which is a so-called high-pressure dome type swing compressor, has a compression section 2 placed below and a motor 3 placed above in a casing 1. The compression section 2 is driven via a drive shaft 12 by a rotor 6 of the motor 3.

The compression section 2 sucks in a refrigerant gas from an unshown accumulator. The refrigerant gas can be obtained by controlling unshown condenser, expansion mechanism and evaporator which are combined with the rotary compressor to constitute an air conditioner as an example of refrigeration systems.

The rotary compressor discharges high-temperature, high-pressure compressed refrigerant gas from the compression section 2 to make the casing 1 filled therewith, and cools the motor 3 through a gap between a stator 5 and the rotor 6 of the motor 3, thereafter discharging the gas outside through a discharge pipe 13. Lubricating oil 9 is accumulated at a lower portion of high-pressure region within the casing 1.

Figure 2:
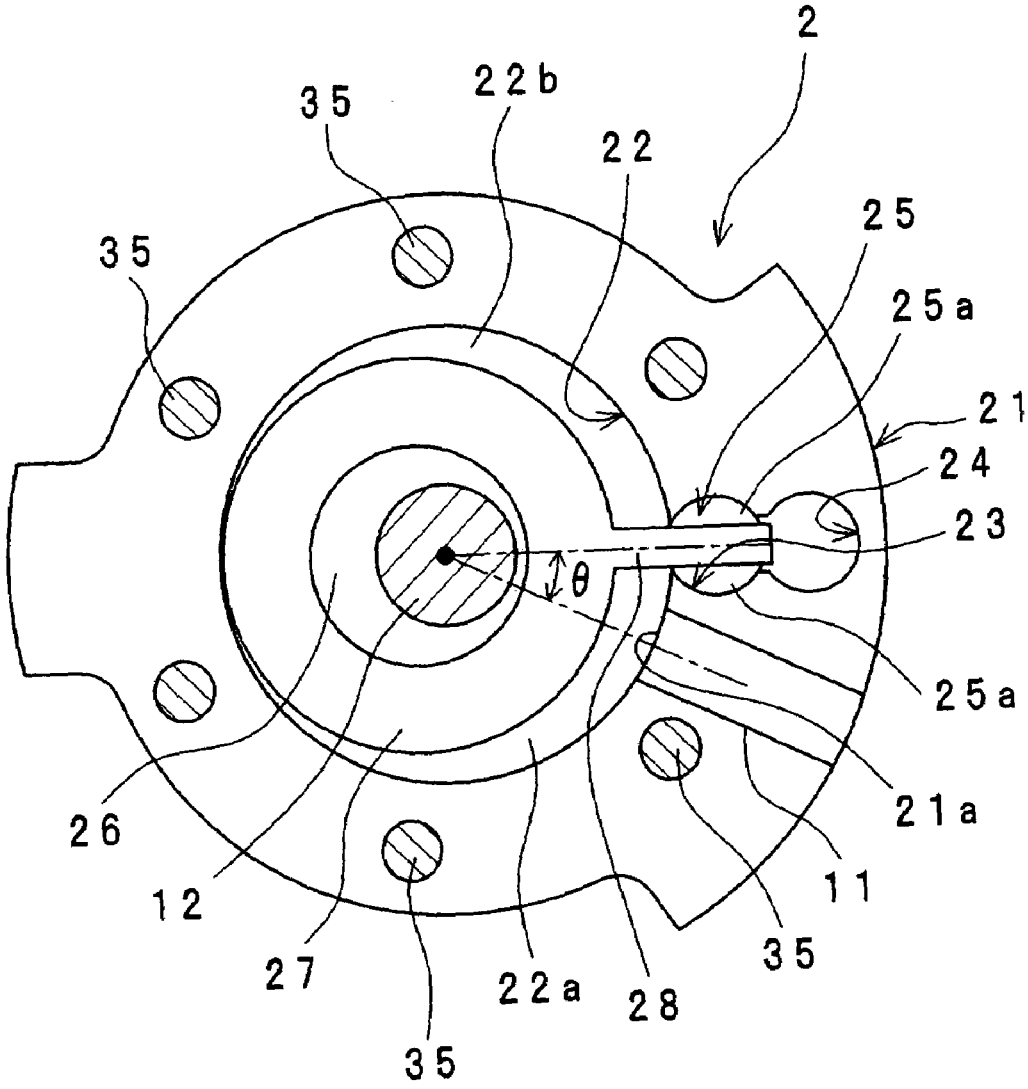
FIG. 2 is a horizontal sectional view of a main part of the rotary compressor.

As shown in FIGS. 1 and 2, the compression section 2 includes a cylinder body 21 forming a cylinder chamber 22, and an upper end plate member 50 and a lower end plate member 60 which are fitted at upper and lower opening ends, respectively, of the cylinder body 21 to close the cylinder chamber 22.

The drive shaft 12 extends through the upper end plate member 50 and the lower end plate member 60 so as to enter inside the cylinder chamber 22.

A roller 27 fitted to a crankpin 26 provided on the drive shaft 12 is revolvably placed in the cylinder chamber 22 so that compression action is performed by revolutionary motion of the roller 27.

A blade 28 is integrally fitted to the roller 27 radially outward of the roller 27. The interior of the cylinder chamber 22 is partitioned by the roller 27 and the blade 28 into a low-pressure chamber 22*a* and a high-pressure chamber 22*b*. That is, as shown in FIG. 2, in regard to a chamber on the lower side of the blade 28, a suction pipe 11 communicating with the unshown accumulator opens in an inner surface of the cylinder chamber 22 to form the low-pressure chamber (suction chamber) 22*a*. On the other hand, in regard to a chamber on the upper side of the blade 28, a discharge hole 51*a* shown in FIG. 1 opens in the inner surface of the cylinder chamber 22 to form the high-pressure chamber (discharge chamber) 22*b*.

The blade 28 is sealed on both sides by a bush 25. The blade 28 is supported by the bush 25 so that the roller 27 is revolved in the cylinder chamber 22.

More specifically, the cylinder body 21 has a recess portion 23 which opens in the cylinder chamber 22. The bush 25 is fitted into the recess portion 23. The bush 25 is composed of two semicircular pillar-shaped members 25*a*, 25*a* each having a semicircular-shaped cross section.

Both side faces of the blade 28 are sandwiched by the semicircular pillar-shaped members 25*a*, 25*a*. Lubrication between the blade 28 and the bush 25 is done with the lubricating oil 9.

Then, as the crankpin 26 is eccentrically rotated along with the drive shaft 12, the roller 27 fitted to the crankpin 26 is revolved with the outer peripheral surface of the roller 27 kept in contact with the inner peripheral surface of the cylinder chamber 22.

Along with the revolution of the roller 27 in the cylinder chamber 22, the blade 28 is moved back and forth with both side faces of the blade 28 held by the semicircular pillar-shaped members 25*a*, 25*a*. Then, the low-pressure refrigerant is sucked into the low-pressure chamber 22*a* through the suction pipe 11, being compressed in the high-pressure chamber 22*b* into a higher pressure. Thereafter, the high-pressure refrigerant is discharged through the discharge hole 51*a* shown in FIG. 1.

As shown in FIG. 1, the upper end plate member 50 has a disc-shaped body portion 51 and a boss portion 52 provided upward at a center of the body portion 51. The drive shaft 12 is inserted in the body portion 51 and the boss portion 52. In the body portion 51, the discharge hole 51*a* is provided so as to communicate with the cylinder chamber 22.

A discharge valve 31 is fitted on the body portion 51 so as to be located on one side of the body portion 51 opposite to the side on which the cylinder body 21 is provided. The discharge valve 31, which is, for example, a reed valve, opens and closes the discharge hole 51*a*.

The lower end plate member 60 has a disc-shaped body portion 61 and a boss portion 62 provided downward at a center of the body portion 61. The drive shaft 12 is inserted in the body portion 61 and the boss portion 62.

The upper end plate member 50 (or the upper end plate member 50 and the lower end plate member 60) and the cylinder body 21 are tightened to each other by bolts. That is, as shown in FIG. 2, the cylinder body 21 has the periphery of the cylinder chamber 22 tightened with a plurality of bolts 35. The plurality of bolts 35 are placed at a specified pitch along the peripheral direction about the drive shaft 12 in the cylinder body 21.

As shown in FIG. 1, a width $W_1$ of the bush 25 in the roller axis direction is larger than an axial width $W_2$ of the roller 27. A gap in the roller axis direction between the roller 27 and the end plate members 50, 60 is larger than a gap in the roller axis direction between the bush 25 and the end plate members 50, 60.

That is, the gap in the roller axis direction between the roller 27 and the end plate members 50, 60 can be set to a large one. Moreover, the gap in the roller axis direction between the bush 25 and the end plate members 50, 60 can be set to a smaller one at the same time.

Thus, even if the roller 27 is affected by flexure due to a differential pressure between the high-pressure refrigerant gas and the low-pressure refrigerant gas or thermal expansion due to the high-pressure refrigerant gas, the end face of the roller 27 and the end faces of the end plate members 50, 60 are not brought into pressure contact with each other. As a result, seizures between the roller 27 and the end plate members 50, 60 are prevented.

Also, in the tightening of the end plate member 50 and the cylinder body 21 to each other by the bolts 35, even if the end plate member 50 near the bolts 35 is deformed, seizures due to contact between the end face of the roller 27 and the end faces of the end plate members 50, 60 are prevented.

Further, in compression, the refrigerant gas present in the high-pressure chamber 22*b* can be prevented from passing through the gap in the roller axis direction between the bush 25 and the end plate members 50, 60 and leaking into the low-pressure chamber 22*a*. Moreover, the refrigerant gas can be prevented from leaking into the cylinder chamber 22 from a space 24 located outer than the bush 25 in the radial direction of the roller 27 (i.e., a space behind the bush 25).

Thus, seizures between the roller 27 and the end plate members 50, 60 in compression can be prevented so that leaks of the refrigerant gas in compression can be reduced while the reliability is maintained. Thus, the rotary compressor can be improved in performance.

In short, the bush 25, which is not present in the cylinder chamber 22, is almost never affected by the foregoing flexure due to the differential pressure or thermal expansion. Still, since there occurs almost no influence of strain due to the tightening of the bolts between the bush 25 and the end plate members 50, 60, the gap in the roller axis direction between the bush 25 and the end plate members 50, 60 can be set to a small one.

Further, since the gap in the roller axis direction between the bush 25 and the end plate members 50, 60 can be reduced, oblique contact of the bush 25 against the end plate members 50, 60 can be prevented, so that reduction in swing loss of the blade 28 as well as prevention of abnormal wear of the bush 25 can be achieved.

Figure 3:
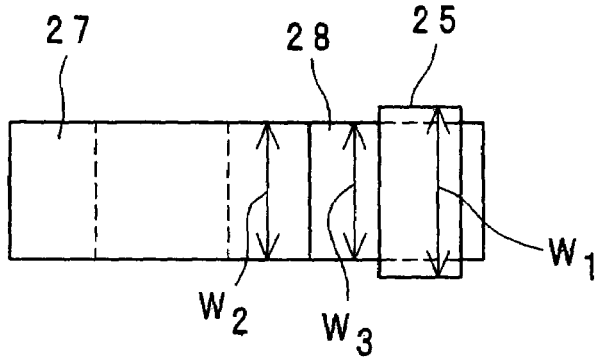
FIG. 3 is a front view of a main part of the rotary compressor.

As shown in FIGS. 1 and 3, the width $W_1$ of the bush 25 in the roller axis direction is larger than a width $W_3$ of the blade 28 in the axial direction of the roller 27, and the gap in the roller axis direction between the blade 28 and the end plate members 50, 60 is larger than the gap in the roller axis direction between the bush 25 and the end plate members 50, 60.

More specifically, the axial width $W_2$ of the roller 27 and the width $W_3$ of the blade 28 in the roller axis direction are equal to each other. Axial both end faces of the roller 27 are formed so as to be horizontal and parallel to each other. Both end faces of the blade 28 in the roller axis direction are formed so as to be horizontal and parallel to each other. Both end faces of the roller 27 and both end faces of the blade 28 adjoin so as to be flush with each other.

Thus, the width $W_1$ of the bush 25 in the roller axis direction is larger than the width $W_3$ of the blade 28 in the roller axis direction, and the gap in the roller axis direction between the blade 28 and the end plate members 50, 60 is larger than the gap in the roller axis direction between the bush 25 and the end plate members 50, 60. Thus, even if clearances of the bush 25 and the blade 28 to the end plate members 50, 60 have gone out due to the differential pressure or thermal expansion during the operation, it is only the bush 25 that makes contact with the end plate members 50, 60, keeping the blade 28 from contact therewith, so that seizures of the blade 28 can be prevented.

That is, the blade 28, because of its high sliding speed, when coming into contact with the end plate members 50, 60, would immediately result in a seizure due to heat generation or thermal expansion. On the other hand, the bush 25, because of its low sliding speed, even if having come into contact with the end plate members 50, 60, is less likely to result in a seizure by virtue of its small heat generation. Thus, seizure resistance of the blade 28 can be improved to a great extent.

As shown in FIG. 2, in the inner surface of the cylinder body 21 is provided a suction hole 21*a* which opens to the low-pressure chamber 22*a* to suck the refrigerant gas into the low-pressure chamber 22*a*. The bush 25 is provided in the vicinity of the suction hole 21*a*. The suction hole 21*a* serves as an opening portion of the suction pipe 11.

The roller 27 is revolved in the cylinder chamber 22 to compress the refrigerant gas in the cylinder chamber 22. As viewed in the roller axis direction, an angle θ formed by a line interconnecting a revolutionary center of the roller 27 and a center of the bush 25 and a line interconnecting the revolutionary center of the roller 27 and a center of the suction hole 21*a* is approximately 10 degrees. It is noted that the angle of approximately 10 degrees includes 10 degrees and approximate values around 10 degrees. Thus, "approximately 10 degrees" as used herein, means a reasonable amount of deviation from 10 degrees such that thermal expansion of the bush or bushing 25 is effectively suppressed by the cold refrigerant gas or the strength of the portions in the cylinder body 21 at which the blade 28 is held is improved.

Accordingly, since the bush 25 is provided in the vicinity of the suction hole 21*a*, the bush 25 can be brought into contact with the cold refrigerant gas that is sucked through the suction hole 21*a*, so that thermal expansion of the bush 25 can be suppressed. Thus, excessive wear of the bush 25 can be prevented.

Also, since the angle θ formed by the line interconnecting the revolutionary center of the roller 27 and the center of the bush 25 and the line interconnecting the revolutionary center of the roller 27 and the center of the suction hole 21*a* is approximately 10 degrees, thermal expansion of the bush 25 can be effectively suppressed by the cold refrigerant gas, and moreover strength of portions in the cylinder body 21 at which the blade 28 is held can be improved. That is, if the angle θ is larger than 10 degrees, thermal expansion of the bush 25 cannot be effectively suppressed by the cold refrigerant gas. Conversely, if the angle θ is smaller than 10 degrees, the strength of the portions in the cylinder body 21 at which the blade 28 is held lowers.

Second Embodiment

Figure 4A:
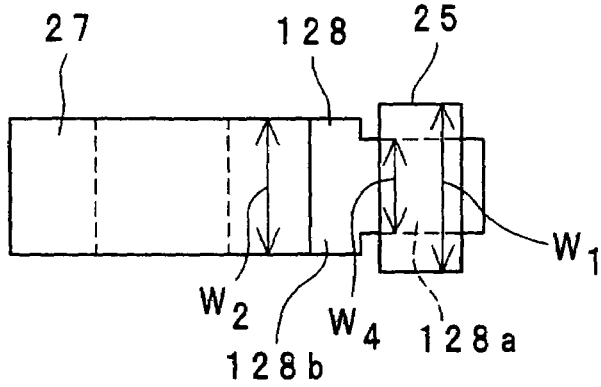
FIG. 4A is a front view showing a second embodiment of the rotary compressor of the invention and showing other blade.
Figure 4B:
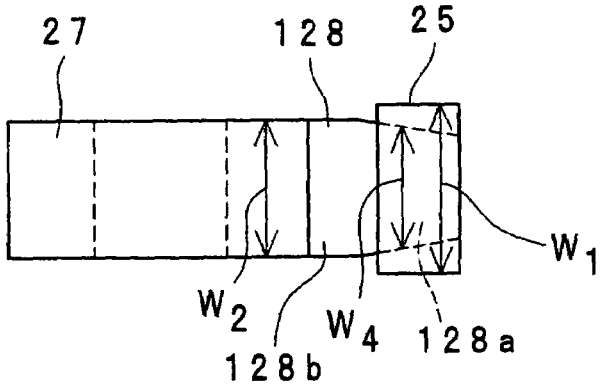
FIG. 4B is a front view showing a second embodiment of the rotary compressor of the invention and showing another blade

FIGS. 4A and 4B show a second embodiment of the present invention. This second embodiment differs in the shape of the blade from the first embodiment shown in FIG. 3. It is noted that like constituent members are designated by like reference numerals in conjunction with the first embodiment shown in FIG. 3 and so their description is omitted.

As shown in FIGS. 4A and 4B, a width $W_4$ in the roller axis direction in at least a sealed portion 128*a* of a blade 128 sealed by the bush 25 is smaller than the axial width $W_2$ of the roller 27.

A gap in the roller axis direction between the sealed portion 128*a* of the blade 128 and the end plate members 50, 60 (shown in FIG. 1) is larger than a gap in the roller axis direction between the roller 27 and the end plate members 50, 60.

The sealed portion 128*a* is a tip end portion of the blade 128. A base end portion of the blade 128 is a non-sealed portion 128*b* which is not sealed by the bush 25.

More specifically, in FIG. 4A, both end faces of the sealed portion 128*a* in the roller axis direction are formed so as to be horizontal and parallel to each other. Both end faces of the non-sealed portion 128*b* in the roller axis direction are formed so as to be horizontal and parallel to each other.

Both end faces of the roller 27 and both end faces of the non-sealed portion 128*b* adjoin so as to be flush with each other. Both end faces of the sealed portion 128*a* are positioned inner in the roller axis direction than both end faces of the non-sealed portion 128*b*. That is, the width $W_4$ of both end faces of the sealed portion 128*a* is smaller than the width of both end faces of the non-sealed portion 128*b*. In short, both end faces of the sealed portion 128*a* are formed stepped. The width of both end faces of the non-sealed portion 128*b* is equal to the width $W_2$ of the roller 27.

On the other hand, FIG. 4B differs from FIG. 4A in that both end faces of the sealed portion 128*a* are so formed as to become closer to each other toward the tip end side. In short, both end faces of the sealed portion 128*a* are formed tapered.

Although not shown, the width of the non-sealed portion 128*b* in the roller axis direction may be smaller than the axial width $W_4$ of the roller 27.

As shown above, the width $W_4$ in the roller axis direction of at least the sealed portion 128*a* in the blade 128 is smaller than the axial width $W_2$ of the roller 27, and the gap in the roller axis direction between at least the sealed portion 128*a* in the blade 128 and the end plate members 50, 60 is larger than the gap in the roller axis direction between the roller 27 and the end plate members 50, 60. Therefore, lubricating oil more easily enters to between the sealed portion 128*a* and the bush 25, so that the blade 128 and the roller 27 move smoothly against the bush 25. Thus, loss of the compression operation can be reduced.

Third Embodiment

Figure 5A:
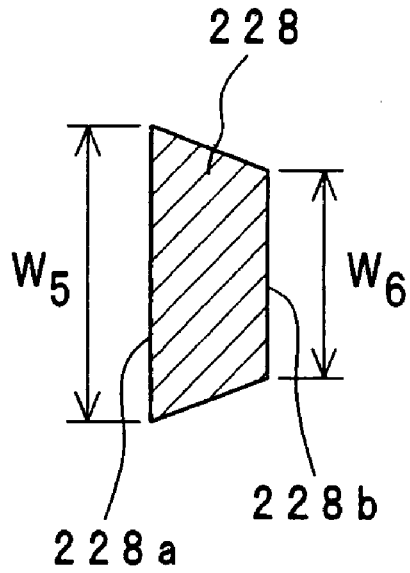
FIG. 5A is a horizontal sectional view showing a third embodiment of the rotary compressor of the invention and showing other blade.
Figure 5B:
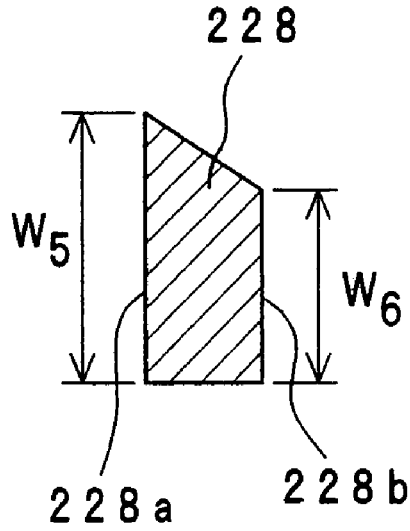
FIG. 5B is a horizontal sectional view showing a third embodiment of the rotary compressor of the invention and showing another blade.

FIGS. 5A and 5B show a third embodiment of the present invention. The third embodiment differs from the first embodiment in the shape of the blade.

As shown in FIGS. 5A and 5B, in a cross section orthogonal to a direction in which a blade 228 extends, a width $W_5$ of one side face 228*a* of the blade 228 on the low-pressure chamber 22*a* (shown in FIG. 2) side in the roller axis direction is preliminarily set larger than a width $W_6$ of the other side face 228*b* of the blade 228 on the high-pressure chamber 22*b* (shown in FIG. 2) side in the roller axis direction.

In this case, as shown in FIG. 2, the blade 228 coincides with the blade 28 as viewed in the roller axis direction, and the direction in which the blade 228 extends coincides with the radial direction of the roller 27.

More specifically, as shown in FIG. 5A, the other side face 228*b* is positioned inner than the one side face 228*a* in the roller axis direction. Both end faces of the blade 228 in the roller axis direction are so tapered as to be gradually closer to each other from the one side face 228*a* toward the other side face 228*b*.

On the other hand, FIG. 5B differs from FIG. 5A in that one end face of the blade 228 in the roller axis direction is so tapered as to be gradually closer to the other end face of the blade 228 from the one side face 228*a* toward the other side face 228*b*. The other end face of the blade 228 is formed horizontal.

As shown above, the width $W_5$ of the one side face 228*a* on the low-pressure chamber 22*a* side is preliminarily set larger than the width $W_6$ of the other side face 228*b* on the high-pressure chamber 22*b* side. Therefore, the cold refrigerant gas on the low-pressure chamber 22*a* side is brought into contact with the one side face 228*a* while the hot refrigerant gas on the high-pressure chamber 22*b* side is brought into contact with the other side face 228*b*. Thus, even if the other side face 228*b* has thermally expanded as compared with the one side face 228*a*, the width of the other side face 228*b* does not become larger than the width of the one side face 228*a* so that the other side face 228*b* is kept from contact with the end plate members 50, 60. Therefore, seizures of the blade 228 can be prevented.

It is noted that the present invention is not limited to the above-described embodiments. For instance, the bush 25 may be formed of one columnar-shaped member and a cutout recess that allows the blade 28 to slide therealong may be formed in the columnar-shaped member. Further, one of the both-side end plate members 50, 60 may be formed integrally with the cylinder body 21.

What is claimed is:

1. A rotary compressor, comprising:

a cylinder body;

end plate members placed on both sides of the cylinder body, the cylinder body and the end plate members defining a cylinder chamber;

a roller and a blade integrally fitted to the roller, the cylinder chamber being internally partitioned into a low-pressure chamber and a high-pressure chamber by the roller and the blade; and a bushing which seals both sides of the blade, portions of the end plate members along which the bushing slides being flat surfaces without a recess, wherein a width of the bushing in a roller axis direction being larger than an axial width of the roller, and a gap in the roller axis direction between the roller and the end plate members being larger than a gap in the roller axis direction between the bushing and the end plate members.

2. The rotary compressor as claimed in claim 1, wherein the width of the bushing in the roller axis direction is larger than a width of the blade in the roller axis direction, and a gap in the roller axis direction between the blade and the end plate members is larger than a gap in the roller axis direction between the bushing and the end plate members.

3. The rotary compressor as claimed in claim 2, wherein a width in the roller axis direction in a sealed portion of the blade sealed by the bushing is smaller than the axial width of the roller, and a gap in the roller axis direction between the sealed portion in the blade and the end plate members is larger than the gap in the roller axis direction between the roller and the end plate members.

4. The rotary compressor as claimed in claim 1, wherein in an inner surface of the cylinder body, a suction hole is provided so as to open to the low-pressure chamber and to suck a refrigerant gas into the low-pressure chamber, and the bushing is provided in the vicinity of the suction hole.

5. The rotary compressor as claimed in claim 4, wherein the roller is revolved in the cylinder chamber to compress the refrigerant gas present in the cylinder chamber, as viewed in the roller axis direction, an angle formed by a line interconnecting a revolutionary center of the roller and a center of the bushing and a line interconnecting the revolutionary center of the roller and a center of the suction hole is approximately 10 degrees.

6. The rotary compressor as claimed in claim 1, wherein in a cross section orthogonal to a direction in which the blade extends, a width of one side face of the blade on the low-pressure chamber side in the roller axis direction is preliminarily set larger than a width of the other side face of the blade on the high-pressure chamber side in the roller axis direction.

* * * * *